US011724777B2

(12) United States Patent
Mingucci

(10) Patent No.: US 11,724,777 B2
(45) Date of Patent: Aug. 15, 2023

(54) SAILING BOAT WITH AN INVERTED U-SHAPED MAST

(71) Applicant: Stramba S.R.L

(72) Inventor: Daniele Mingucci, Riccione (IT)

(73) Assignee: STRAMBA S.R.L., Riccione (IT)

( * ) Notice: Subject to any disclaimer, the term of this patent is extended or adjusted under 35 U.S.C. 154(b) by 0 days.

(21) Appl. No.: 17/263,250

(22) PCT Filed: Aug. 5, 2019

(86) PCT No.: PCT/IB2019/056633
§ 371 (c)(1),
(2) Date: Jan. 26, 2021

(87) PCT Pub. No.: WO2020/031053
PCT Pub. Date: Feb. 13, 2020

(65) Prior Publication Data

US 2021/0163101 A1 Jun. 3, 2021

(30) Foreign Application Priority Data

Aug. 10, 2018 (IT) ..... 102018000008059

(51) Int. Cl.
*B63B 15/00* (2006.01)
*B63H 9/061* (2020.01)
*B63H 9/08* (2006.01)

(52) U.S. Cl.
CPC ..... *B63B 15/0083* (2013.01); *B63H 9/0621* (2020.02); *B63B 2015/0016* (2013.01); *B63H 2009/086* (2013.01)

(58) Field of Classification Search
CPC ..... B63B 15/0083; B63B 2015/0016; B63B 2015/0025; B63B 15/00; B63B 2035/009;
(Continued)

(56) References Cited

U.S. PATENT DOCUMENTS 449,472 A * 3/1891 Follett ..... B63B 21/08 114/112
3,112,725 A * 12/1963 Malrose ..... B63B 1/12 114/39.28

FOREIGN PATENT DOCUMENTS

FR 2068031 8/1971
FR 2825341 A1 12/2002
(Continued)

OTHER PUBLICATIONS

International Search Report for parent PCT/1B2019/05663 dated Nov. 27, 2019.

*Primary Examiner* — Daniel V Venne
(74) *Attorney, Agent, or Firm* — Schott, PC.

(57) ABSTRACT

A sailing boat includes at least one mast with at least one first and one second section projecting upwards with respect to the hull and arranged facing each other in the orthogonal direction to the advancement direction for supporting a mainsail in two mutually specular and alternative operating positions, where the sections are connected and spaced out from each other by at least one overturning section of the mainsail placed at the top of them to allow the passage from one specular position to the other. The three sections of mast define for that purpose a first sliding guide for the whole mainsail that extends substantially along the whole extension length of the mast and the mast includes a second sliding guide positioned substantially at the top thereof and placed aft with respect to the overturning section.

16 Claims, 6 Drawing Sheets

(58) Field of Classification Search
CPC ..... B63H 9/0621; B63H 2009/086; Y02T 70/5236
USPC ..... 114/114, 39.21, 39.29, 39.32
See application file for complete search history.

(56) References Cited

FOREIGN PATENT DOCUMENTS

| | | | |
|---|---|---|---|
| WO | 2010103377 | A1 | 9/2010 |
| WO | 2017178913 | A1 | 10/2017 |

* cited by examiner

SAILING BOAT WITH AN INVERTED U-SHAPED MAST

BACKGROUND OF THE INVENTION

In the sector of sailing boats the use of the "Bermuda" rig is particularly widespread, characterised by an aft sail of the mast reeved therein for its entire height and base regulated by the boom in turn controlled by a sheet.

For the purpose of improving the performance and facilitating the use of the boat, new rigs are constantly being proposed.

One of the most significant attempts in the competitive field is the replacement of sails with rigid wings. They are substantially like the wings of aeroplanes, that is, they differ from sails because instead of being composed of a yielding sheet, generally canvas or the like, they have a thickness shaped to form a solid aerodynamic profile.

Although the performance is greater than a sail, this solution presents notable disadvantages.

First of all, the weight of the rig is much greater than that of a rig with a sail, as it must not only comprise a rigid wing, but also a mast and relative manoeuvres that are strong enough to control it. Certain operations are impossible or are rendered more complicated, such as lowering. For these reasons, the control of such a wing is reserved to professionals, and is not feasible on pleasure boats. Last but not least is the very high cost.

The applicant, in the previous international patent application WO2017/178913, proposed a rig with an inverted U-shaped mast for the specular overturning of the sail. Although this solution allows the use of mainsails with asymmetrical airfoil thickness, and therefore potentially higher performance, there is the intrinsic problem of great sensitivity to the wind, with the possibility of loss of control, especially during the manoeuvring steps.

In patent literature, suggestions can be found that move towards different types of U-shaped rigs, in particular with sails of a more similar type to lateen than Bermuda sails, easier to control thanks to the presence of the crab claw boom, but with lower performance. Examples are the patent documents FR2825341, DE102004012760, FR2068031, which propose sails "hanging" from a crosspiece, where the halyard point runs substantially horizontally for the easy movement of the inclination of the sail, without overturning it.

SUMMARY OF THE INVENTION

The present invention relates to a sailing boat, a related rig and a related mast. A sail means any device that captures the wind that is able to flex, e.g. for lowering. Therefore, by way of non-limiting example, it comprises any sail made of canvas or the like, including those with airfoil thickness. The invention is particularly adapted to be used for rigging a mainsail, i.e. the main or only sail of the boat.

The aim of the present invention is to overcome all or part of the problems of the prior art, and in particular to exploit the performance of airfoils and Bermuda rigs.

A preferred aim of the present invention is that of providing a wind propulsion system that is easy and cheap to produce, with higher performance and/or easier to manoeuvre than current rigs with Bermuda sails, lateen sails and with rigid wings.

BRIEF DESCRIPTION OF THE DRAWINGS

Further characteristics and advantages of the present invention will become clearer from the following detailed description of the preferred embodiments thereof, with reference to the appended drawings and provided by way of indicative and non-limiting example. In such drawings:

FIG. 3 represents an enlarged scale detail of the second sliding guide of the mast of the previous figures

DETAILED DESCRIPTION OF THE INVENTION

Figure 1A:
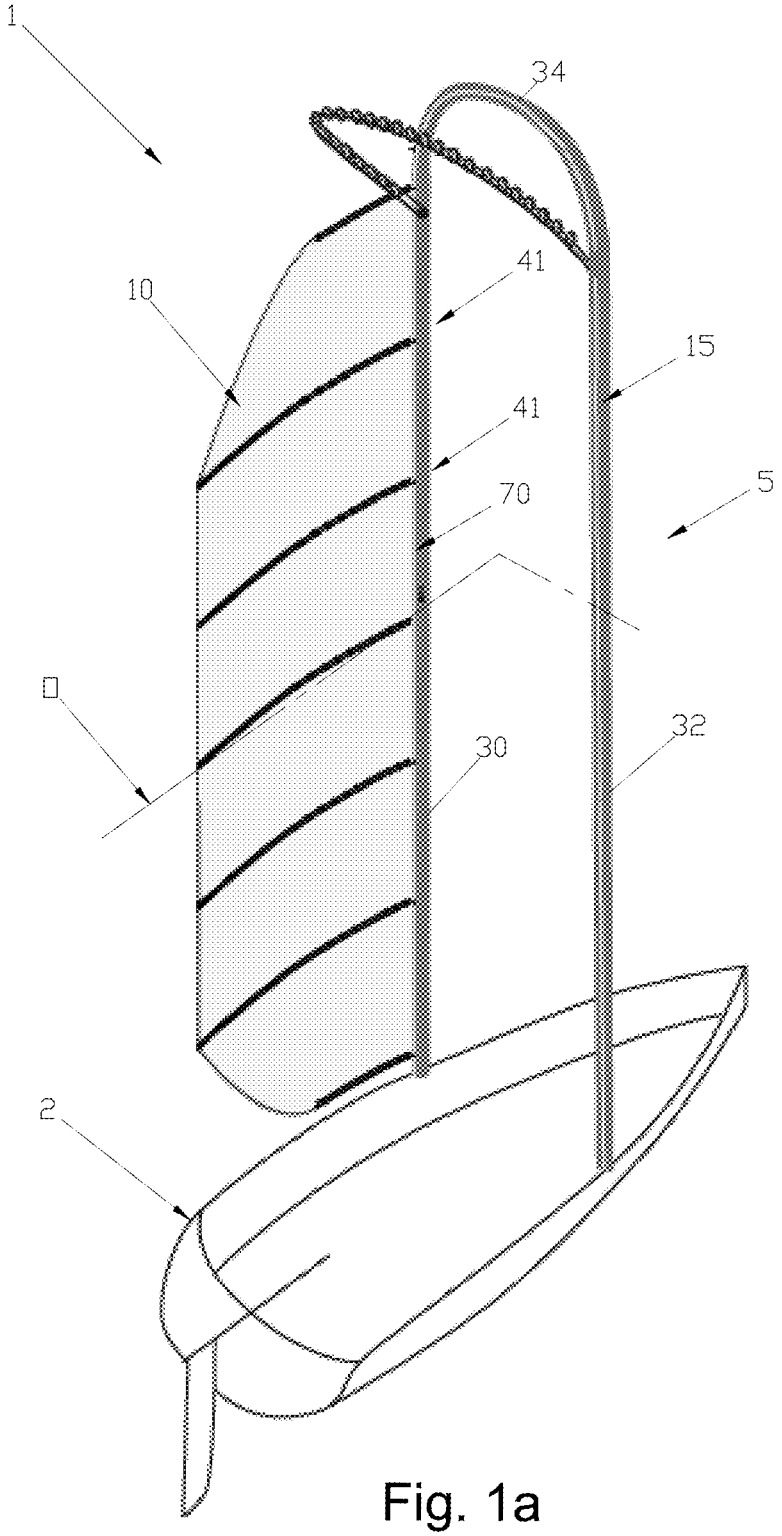
FIG. 1*a* schematically represents a boat according to the present invention for highlighting the general structure thereof.

According to a first general aspect thereof, the present invention relates to a sailing boat comprising at least one hull (2) shaped to define an advancement direction in water (X), at least one rig (5) comprising at least one mast (15) fixed to the hull and at least one mainsail (10) supported by the mast, characterised in that:

- the mast comprises at least one first and one second section (30, 32) projecting upwards with respect to the hull and arranged facing each other in the orthogonal direction to the advancement direction for supporting said mainsail in two mutually specular and alternative operating positions, where said sections are connected and spaced out from each other by at least one overturning section (34) of the mainsail placed at the top of them to allow the passage from one specular position to the other, the three sections of mast defining for that purpose a first sliding guide (35) for the mainsail that extends substantially along the whole extension length of the mast,
- the mainsail (10) is a sail that is deformable so as to adapt to the path of the sliding guide and for the lowering, and in the operating positions it has a prevalent extension in the vertical direction,
- the mainsail has a main edge (70) proximal to the mast (15) and slidably fixed for the whole length thereof to the sliding path,
- the mainsail (10) in the operating position is entirely placed aft with respect to the mast (15),
- the mast comprises a second sliding guide (45, 145) positioned substantially at the top thereof and placed aft with respect to the overturning section (34) to define a support from below, in the vertical direction, and slidable, to the mainsail (10) during the passage in the overturning section (34).

This advantageously prevents the pitching downwards of the mainsail during the necessary overturning for the change of tack. This also allows the creation of taller masts, as at tall heights the winds are stronger and it is no longer a limit for overturning thus becoming an advantage for performance. More generally, the proposed rig has the possibility of also managing and "housing" mainsails with airfoil thickness and optimising the exploitation of any asymmetrical camber along the chord thanks to the inversion of the sail due to the overturning with which the change of tack takes place. This possibility is excluded by lateen sails with crab claw booms.

According to some preferred embodiments of the invention, the second sliding guide is free from constraining means to the mainsail interacting therewith exclusively by resting contact.

Preferably the mainsail is made of canvas or the like.

Preferably, the mast is bipodal and inverted U shaped, where preferably the first and second section are substantially rectilinear.

According to some preferred embodiments the mainsail is substantially trapezoidal or rectangular with the side of the major base arranged to form said proximal edge, where the trapezium or the rectangle, in the operating position, are symmetrical with respect to a substantially horizontal plane of symmetry.

According to some preferred embodiments the mainsail has an airfoil thickness preferably with asymmetrical camber along the chord.

According to some preferred embodiments, the second sliding guide supports the mainsail at least in a distanced point in the horizontal direction with respect to the first sliding guide. Preferably, said support point is a point where there is at least one stiffening element of the mainsail.

According to a general preferable characteristic of the invention, the mainsail comprises a plurality of stiffening elements of the mainsail arranged in succession with each other in the sliding direction, alternating with flexion zones of said surface that allow the adaptation thereof to the sliding path.

The stiffening elements preferably extend along the entire length of the mainsail, i.e. from an edge thereof constrained to the mast at the opposite free edge.

The stiffening elements have a main extension line directed to connect such two edges, being for example sticks.

Preferably, the stiffening elements extend mainly in a substantially horizontal direction.

According to some preferred embodiments of the invention, the stiffening elements are sticks coupled to the mainsail (10), preferably to be in direct contact with the second sliding guide (45).

According to some preferred embodiments of the invention, the ratio between the distance of the successive stiffening elements and the extension of the second sliding guide is such for which, during the passage of the connecting section, at least one of each pair of adjacent stiffening elements is supported by the second guide.

This is particularly practical to realise by shaping the second guide substantially like an arch facing the connecting section 34, and making the distance between the stiffening elements shorter than the length of the arch.

According to some preferred embodiments of the invention, the second sliding guide maintains such surface arranged substantially parallel to the advancement direction.

According to some preferred embodiments of the invention, the mainsail has a free distal edge (71) such as to be movable towards and away from a vertical plane of symmetry (P) of the mast when the mainsail is in the operating positions, where the second sliding guide (45, 145) limits the mobility of the second edge section (71) downwards when the mainsail passes from the overturning section (34) of the first guide.

According to some preferred embodiments of the invention, in the operating configurations, the mainsail does not have any section, or at the most it only has a top portion, placed at the second sliding guide. For example, for an observer who is looking aft from the mast, the second guide extends at the connecting section between the first and second section of the mast, and is absent at the first and second section of the mast, or at the most is usually present at the top of them, the mainsail preferably having an extension in the vertical direction that is less than or equal to the first or the second section of mast.

According to a preferred characteristic the first and second section of mast are substantially rectilinear.

According to some preferred embodiments of the invention, the connecting section extends along a first concave line downwards substantially continually joined to the top of the sections of mast, and the second sliding guide extends along a second concave line downwards that substantially starts at the top of the first and the second section of mast and is distanced from the connecting section remaining substantially facing it in the horizontal direction.

The top of the sections of mast can for example be identified in general in the point in which there is a curvature for joining to the connecting section. It is immediately clear if the first and second section of mast are rectilinear or substantially rectilinear.

In other cases the top may substantially be the point in which the mainsail stops when it is in the operating configuration.

According to some preferred embodiments of the invention, the second sliding guide comprises at least one rod projecting aft from the connecting section between the first and the second section of mast.

According to a set of particularly synergistic preferable characteristics, the mainsail is such for which the first sliding guide comprises a rail and the proximal edge (70) of the mainsail (10) is fixed slidably to the mast through a plurality of carriages (40) slidably coupled to said rail, where the carriages each comprise a sliding point with respect to the rail (35) and a coupling point (41) to said proximal edge, and where each carriage comprises at least one articulated point (42) to allow the mainsail to change inclination with respect to the mast. The mainsail preferably comprises a plurality of stiffening elements connected to the carriages in said coupling points.

According to a second aspect thereof, the invention relates to a rig for a boat comprising at least one mast and a mainsail of the type described above.

According to a third aspect thereof, the invention relates to a mast for a nautical means of the type indicated above.

Figure 1:
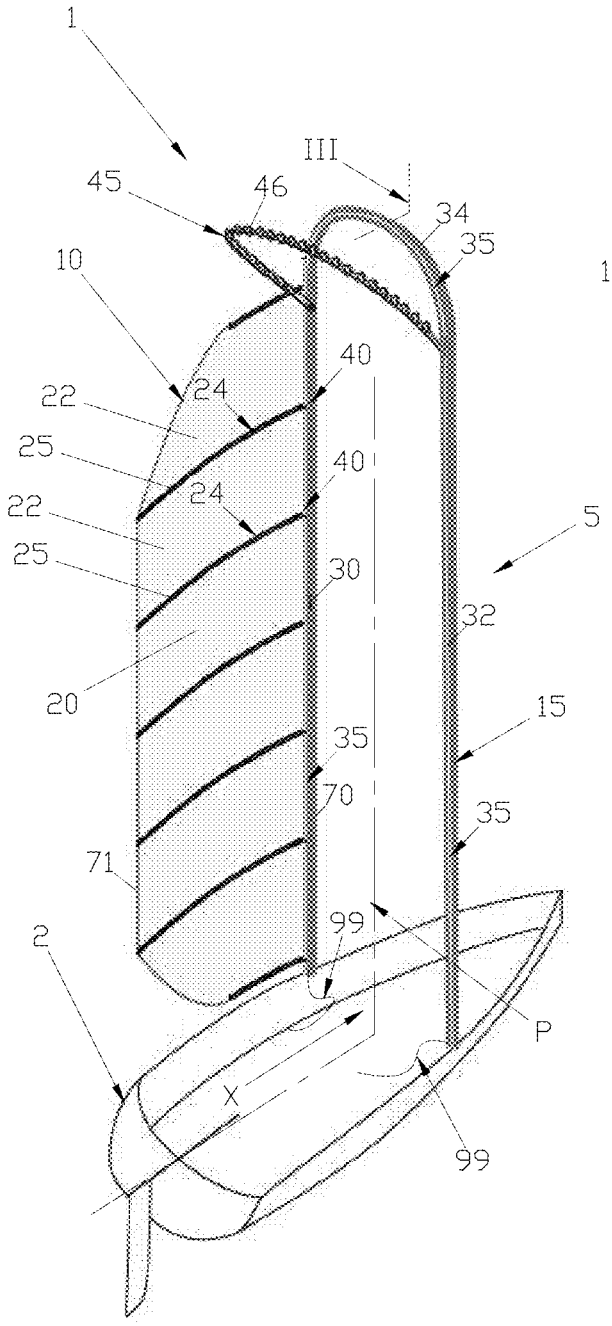
FIGS. 1 and 2 schematically represent the boat of FIG. 1*a* with the mainsail respectively in a first operating position for the propulsion of the boat and in a configuration of passing to a second operating position specular to the first.

With reference to FIGS. 1*a* and 1, a wind propulsion boat is shown which is comprehensively indicated with the reference number 1. The boat 1 comprises a hull 2 and a rig 5, comprising in turn a sail 10 hereinafter also referred to as mainsail, and a mast 15, which supports the mainsail on the hull.

The hull 2 may be of any type, even possibly a multihull, such as for example a catamaran or a trimaran, and identifies with its shape an advancement direction indicated by the arrow X, as well as a plane of symmetry P parallel to such direction.

The mast 15 has a first and a second section 30, 32 projecting upwards from the hull, preferably they are substantially rectilinear and have the function of supporting the mainsail in two respective operating propulsion positions specular to each other. A third section 34 joins the tops of the first and the second section, and is shaped so as to form a continuity of the extension direction of the entire mast. Such section has the function of the overturning section 34 of the mainsail 10 for passing from one of the operating configurations to the other in the change of tack.

Preferably, the shape of the mast is a bipodal overturned U.

According to a general preferable characteristic the mast has a distance between the first and the second section 30 and 32 such as to embrace all or most of the hull 2. Such characteristic is advantageous for increasing the habitability on board. However, cases are also envisaged in which this can be sacrificed, especially during a race, e.g. in the event in which it is decided to adopt as the wind capturing surface the one facing the opposite side to that facing the plane P. Therefore, in that case, the opening of the fork defined by the mast can also be very narrow.

The mainsail 10 in the operating position has a main vertical extension and has a substantially trapezoidal or rectangular shape where the major base 70 is fixed slidably to the mast along the whole length thereof. The mainsail is symmetrical with respect to a substantially horizontal plane O so as to be able to be overturned between the two specular operating positions. The mainsail 10 in the operating position is entirely placed aft with respect to the mast 15.

The mainsail has no boom, whereas as can be seen below it is preferable for there to be a plurality of stiffening sticks 25 distributed in the mainsail.

Figure 2:
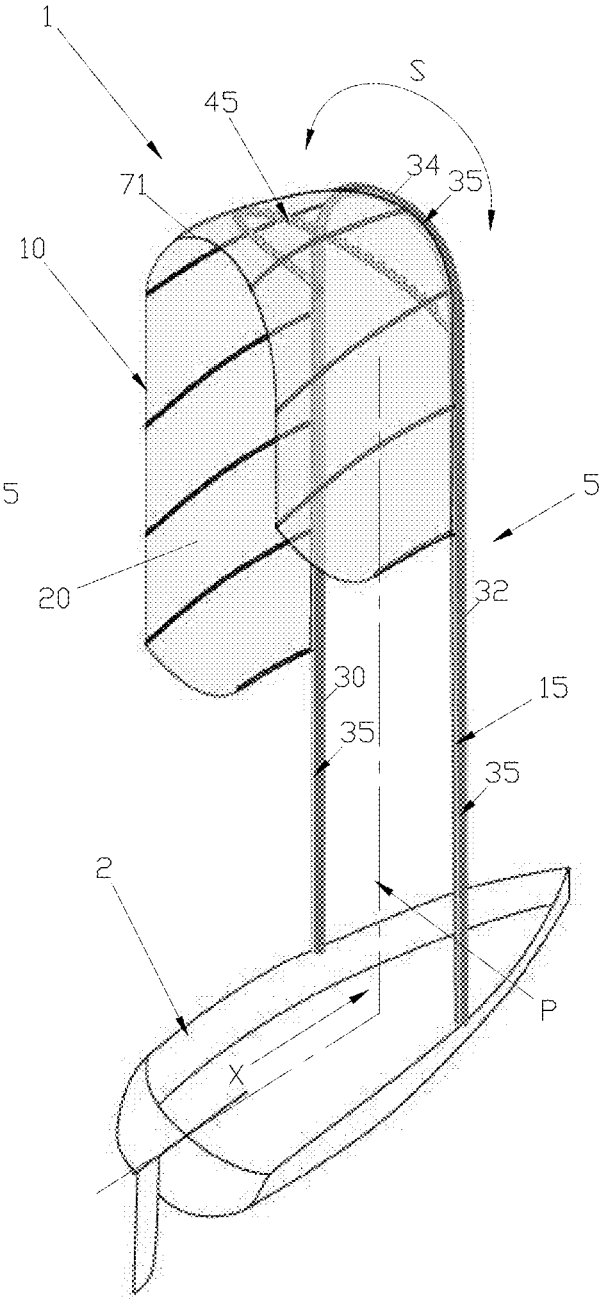

The mast 15 comprises a first guide 35 for slidably guiding the mainsail 10 along its own extension line, preferably along the "entire" extension line. The first guide 35 is present in each of the three sections 30, 32, 34 and is continuous in the passages between them, so that the mainsail can be overturned by sliding between the two specular operating positions with respect to the plane of symmetry P. The line S of FIG. 2 indicates the sliding direction. The operating configurations are those in which the mainsail is supported by the first or by the second section 30, 32 (FIG. 1) whereas the overturning configuration between them is the one in which the device passes at the overturning section 34 (FIG. 2).

Figure 3:
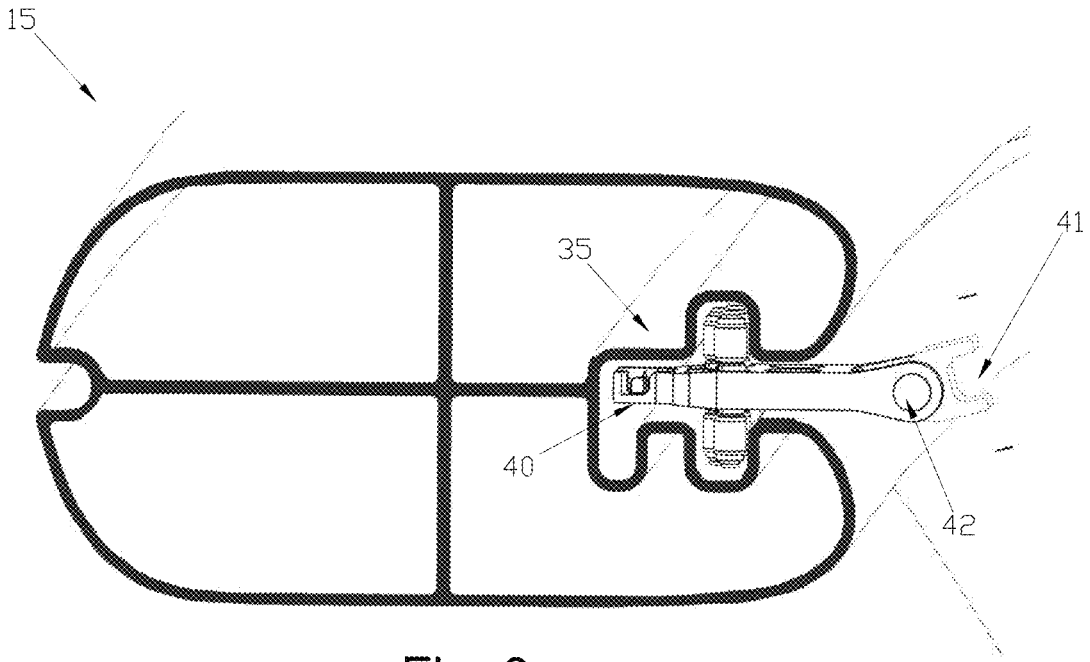
FIG. 3 schematically represents a section of the mast of the boat according to the plane III of FIG. 1.

The section of FIG. 3 shows an example of a sliding guide 35, created in the form of a channel inside the mast 15. The mast is preferably a U-shaped folded profile, so that the channel 35 travels along its entire extension line. Other examples are not excluded in which the guide is outside the mast, being for example a protuberance.

In general it is preferable for the mainsail to be supported by the mast 15 through a plurality of coupling carriages 40, visible in FIG. 3. The carriages are provided with one or more wheels slidably retained by the guide 35, which acts as a rail. In the example illustrated the rail is internal and the carriage is inserted therein, however other solutions are not excluded, such as an external rail, e.g. T-shaped, with a carriage placed to embrace it.

The carriages 40 provide predetermined joining points 41 between the mast and the proximal edge 70 of the mainsail, and preferably also allow the separation thereof. Such joining points 41 are placed in succession with each other in the sliding direction S and between one and the other there is at least one flexion zone 22 of the mainsail 10. For example, each carriage 40 is connected to a stiffening element 25.

The carriages 40 can also act as coupling points for one or more ropes 99 (visible in FIG. 1), also known as halyards, for hoisting, lowering and/or overturning the mainsail 10, e.g. such ropes can pass into the mast, e.g. in the first guide 35, so that they are also guided directly or indirectly along the extension of the mast 15, in particular in all three sections 30, 32 and 34.

The mainsail 10 comprises at least one surface used to capture the wind 20 which, thanks to the overturning described above, always remains the same in each of the two specular operating configurations allowed by the mast.

The mainsail 10 is generally able to flex, in particular it comprises an alternation of flexion zones 22 and rigid zones 24 in the sliding direction S, where the latter comprise stiffening elements 25. The capture device is therefore able to be deformed by flexion to follow the profile of the first sliding guide 35.

The stiffening elements 25 preferably extend from the edge 70 of the mainsail connected to the mast, at the opposite free edge 71. They preferably have a substantially horizontal arrangement and are substantially parallel to each other.

In the example of FIGS. 1 and 2, the mainsail 10 is a sail made of canvas or the like, where the surface used to capture the wind 20 is the face turned towards the plane of symmetry P. The stiffening elements 25 are sticks applied to the sail 20, e.g. externally on the wind capture surface, and the flexion zones 22 are the zones made of canvas or the like between one stick 24 and another.

In general, the mast 15 comprises at the joining section 34 a second guide 45 that defines a second path or sliding guide point for the mainsail. The second guide 45 is distanced in the horizontal direction and aft with respect to the first guide 35, and in general defines a path or sliding point facing the first guide 35.

In general the second sliding guide 45 is preferably a support for the mainsail 10, which rests thereon in the passage configuration at the joining section 34, preferably without coupling constraints.

In the example of FIGS. 1 and 2, the second sliding guide 45 is a support arch for supporting the mainsail anchored at the tops of the first and second section of mast 30, 32, from which it projects upwards away from the joining section 34 in the aft direction. The second sliding guide 45 can in general be optionally provided with wheels or sliding rollers 46.

In general the wear of the mainsail due to rubbing against the second guide 45 can be limited by interposing the sticks between it and the wind capture surface 20.

Some embodiments and variants of the invention are illustrated below where same or similar elements to those described above will be indicated with the same reference numbers or with the same numbers increased by 100 or multiples thereof.

Figure 4:
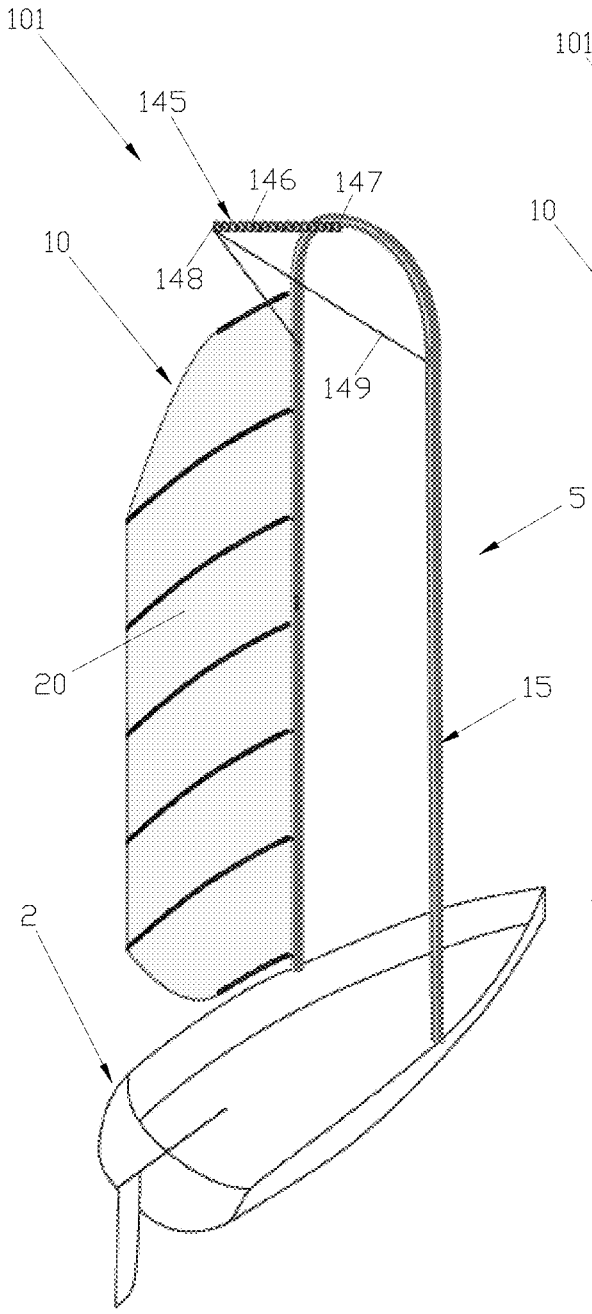
FIGS. 4 and 5 show an alternative embodiment to that of FIGS. 1 and 2.
Figure 5:
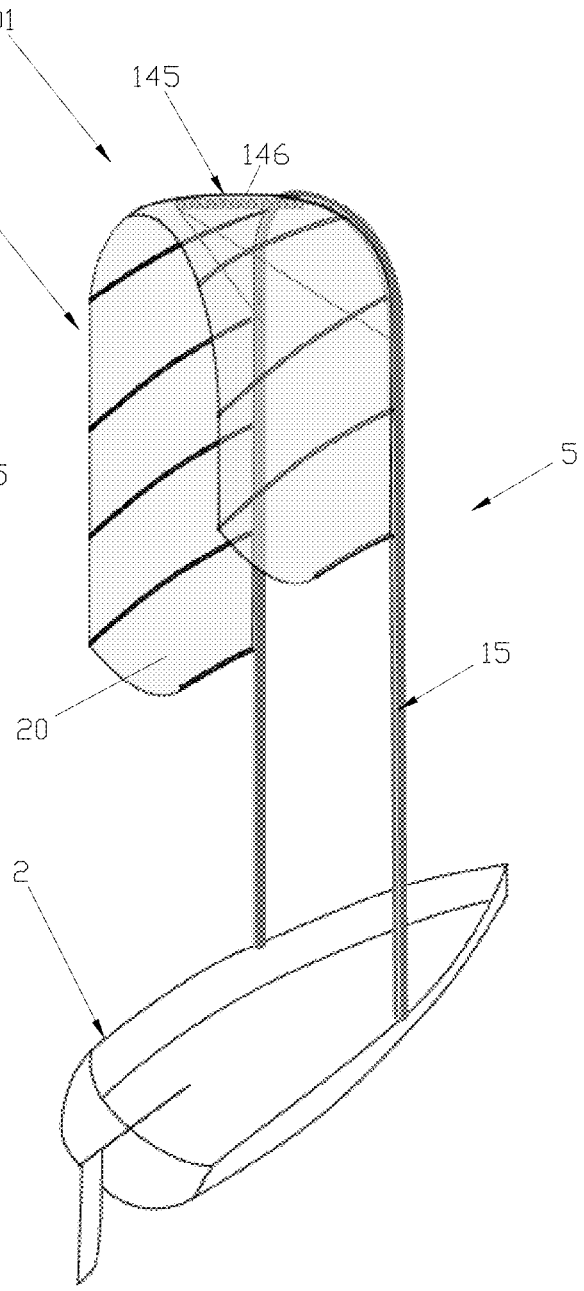

FIGS. 4 and 5 illustrate an alternative embodiment of a boat according to the present invention indicated overall by reference number 101 and that differs from the boat 1 of FIGS. 1 and 2 substantially due to the shape of the second sliding guide 145.

The latter comprises a rod 145 projecting aft from the joining section 34. The rod extends, preferably substantially horizontally, from one connecting end 147 with the joining section 34, at a free end 148 closer to the stern. The rod preferably comprises one or more supports, e.g. one or more further rods 149 for support against the mast 15.

Figure 8:
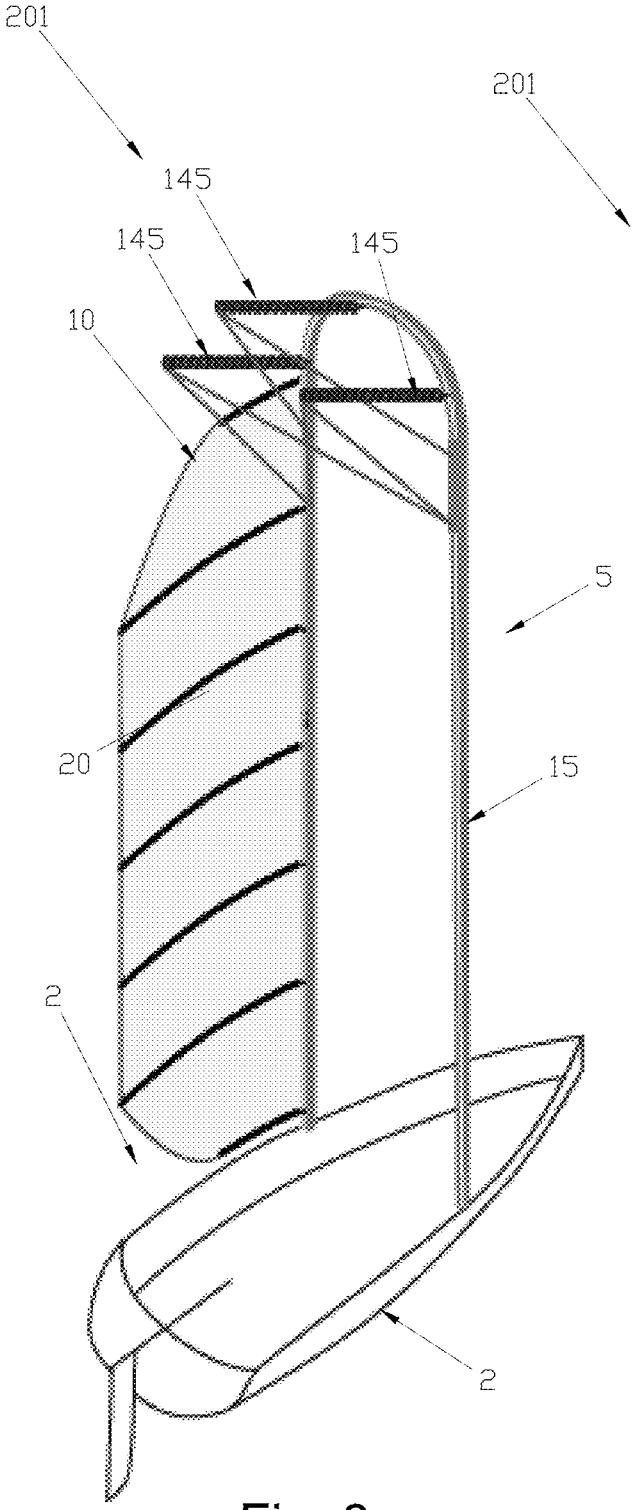
FIGS. 8 and 9 represent a variant of the embodiments of FIGS. 4 and 5.
Figure 9:
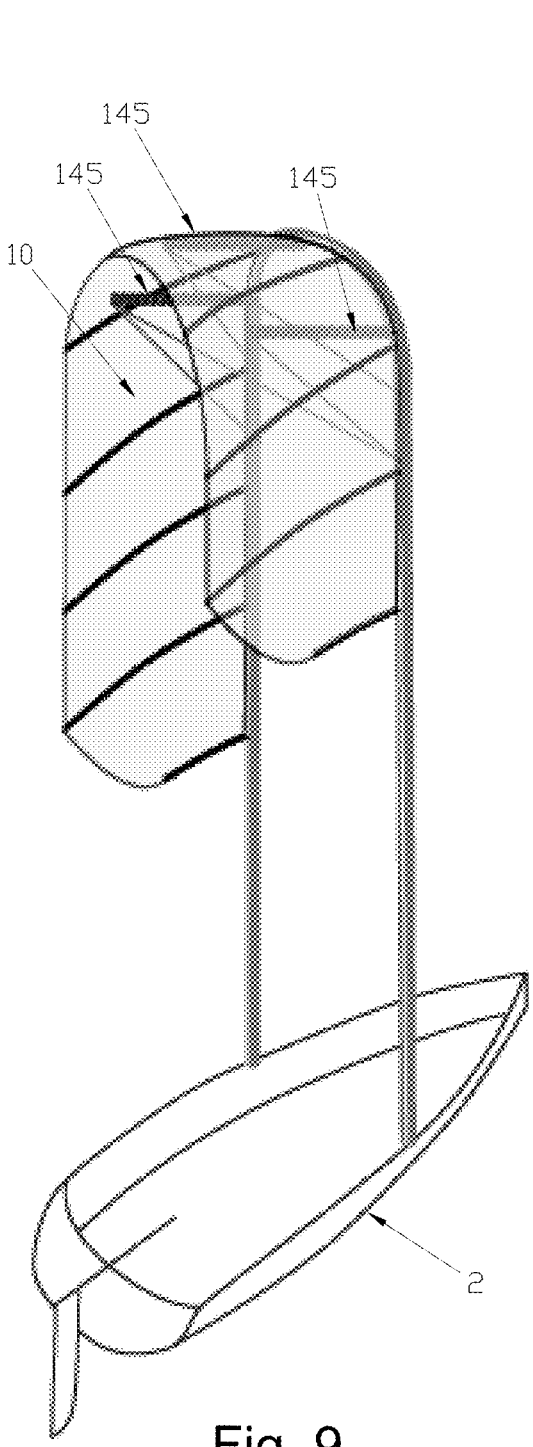

It is not excluded that the second guide 145 comprises more than one rod like the one described, e.g. arranged parallel to each other in succession along the extension direction of the first guide. An example with 3 rods, arranged at different heights from each other, is illustrated in FIGS. 8 and 9 and indicated overall with the reference number 201.

Figure 6:
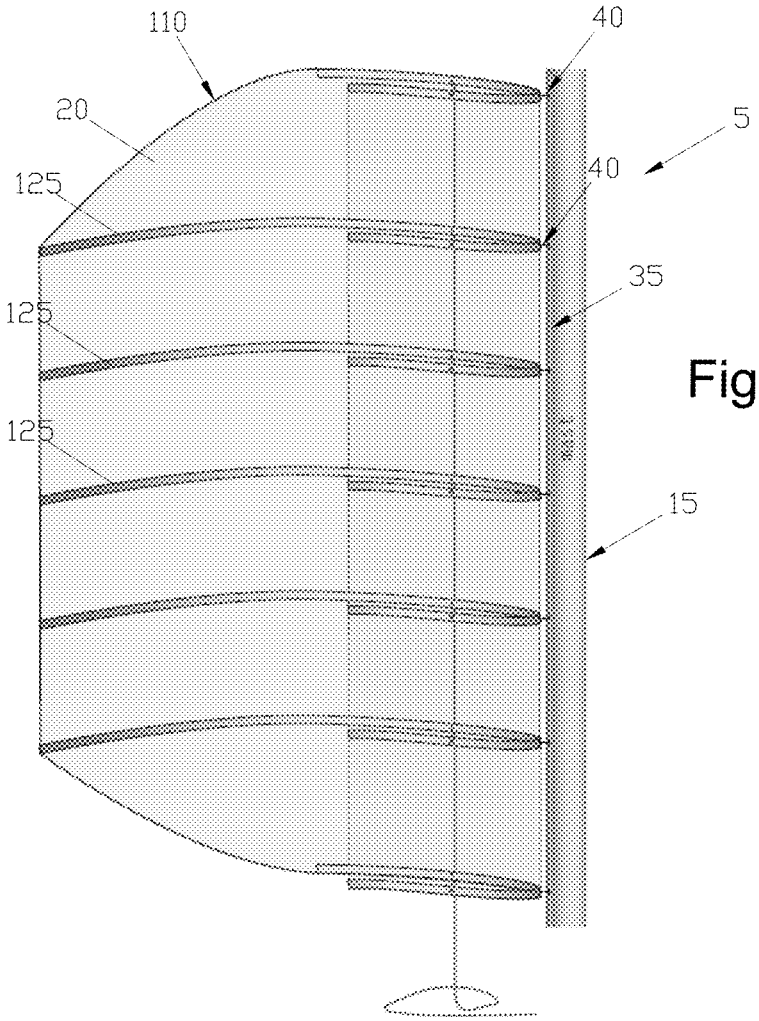
FIG. 6 shows an alternative embodiment of a sail with respect to the one adopted in the previous figures.

FIG. 6 shows an alternative embodiment of a mainsail 110 that differs from the mainsail 10 of FIGS. 1 and 2 due to the fact that it is a sail made of canvas or the like kept folded to form an airfoil by means of the plurality of stiffening sticks 125 shaped like a fork.

Figure 7:
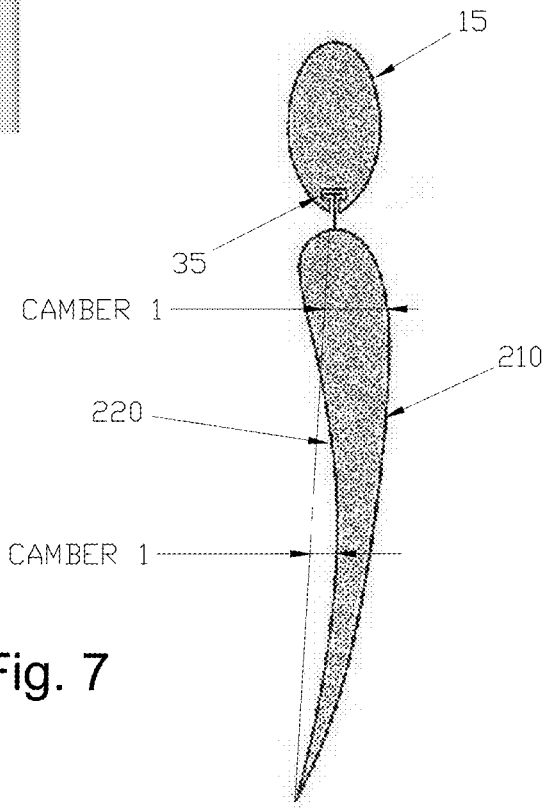
FIG. 7 generally shows the applicability of any airfoil to a sail according to the present invention.

FIG. 7 generally shows the applicability of any airfoil to a mainsail according to the present invention. It is observed that the airfoil preferably has an asymmetrical camber along the chord, in particular it preferably has a concave side and a convex one, and the wind capture face 220 is the concave one. The figure shows the asymmetrical distribution of the thicknesses in a section of the airfoil of the sail highlighting the two central thicknesses with respect to the chord and indicating them with camber 1 and camber 2.

This naturally does not exclude sails without an airfoil, or with a symmetrical airfoil.

In use, the mainsail 10 is normally placed in one of the operating configurations in which it is supported on the first or on the second section of mast 30, 32. In such position the surface that captures the wind 20 is turned towards the plane of symmetry P, and its inclination with respect thereto can be modified to obtain a desired interaction with the wind.

The wind that interacts with such face generates the propulsive thrust of the boat.

In the event in which it is necessary to change the side of the boat on which the wind is received, known as a change of tack, such as in the case of veering or tacking (also known as gybing) the mainsail overturning manoeuvre is performed. The latter is placed sliding along the first sliding guide 35. During the passage at the joining section 34 of the mast, it is supported by the second sliding guide 45, 145 to prevent it falling down again due to the effect of its own weight or gusts of wind. In this way the surface that captures the wind, unlike Bermuda sails, remains the same in every configuration, to the advantage of the possibility to use optimised asymmetrical cambers.

It is generally observed that the drawings proposed have a surface used for capturing placed on the internal side of the boat, i.e. the one facing the plane P. However it is perfectly possible to hypothesise, especially during a race, a solution with a wind capture surface on the opposite side of the mainsail 10 with respect to the plane P. From first considerations it appears that this solution provides higher performance.

It is also observed that mainsails are not excluded where the two main faces can be used indifferently by choice as wind capture surfaces. This is the case for example of sails made of canvas or the like with a constant section thickness.

General Interpretation of Terms

In understanding the object of the present invention, the term "comprising" and its derivatives, as used herein, are intended as open-ended terms that specify the presence of declared characteristics, elements, components, groups, integers and/or steps, but do not exclude the presence of other undeclared characteristics, elements, components, groups, integers and/or steps. The above also applies to words that have similar meanings such as the terms "comprised", "have" and their derivatives. Furthermore, the terms "part", "section", "portion", "member" or "element" when used in the singular can have the double meaning of a single part or a plurality of parts. As used herein to describe the above executive form, the following directional terms "forward", "backward", "above", "under", "vertical", "horizontal", "below" and "transverse", as well as any other similar directional term, refers to a boat in operating navigation position. Finally, terms of degree such as "mainly", "about" and "approximately" as used herein are intended as a tolerance that comprises the exact term and a reasonable amount of deviation of the modified term such that the final result is not significantly changed.

While only selected embodiments have been chosen to illustrate the present invention, it will be apparent from this description to those skilled in the art that various modifications and variations can be made without departing from the scope of the invention as defined in the appended claims. For example, the size, shape, position or orientation of the various components can be modified as needed and/or desired. The components shown which are directly connected or in contact with each other can have intermediate structures arranged between them. The functions of one element can be performed by two and vice versa. The structures and functions of one embodiment can be adopted in another embodiment. All the advantages of a particular embodiment do not necessarily have to be present at the same time. Any characteristic that is original compared to the prior art, alone or in combination with other characteristics, should also be considered a separate description of further inventions by the applicant, including the structural and/or functional concepts embodied by such characteristics. Therefore, the foregoing descriptions of the embodiments according to the present invention are provided for illustrative purposes only and not for the purpose of limiting the invention as defined by the appended claims and their equivalents.

I claim:

1. A sailing boat comprising at least one hull shaped to define an advancement direction in water, at least one rig comprising at least one mast fixed to the hull and at least one mainsail supported by the at least one mast, wherein:

the at least one mast comprises at least one first and one second section projecting upwards with respect to the hull and arranged facing each other in an orthogonal direction to the advancement direction, wherein the first and second sections support the mainsail in two mutually specular and alternative operating positions, wherein the sections are connected and spaced out from each other by at least one overturning section located at a top of each section to allow a passage of the mainsail from one specular position to another specular position defining the two mutually specular positions, wherein the sections of the mast define a first sliding guide for the mainsail that extends substantially along the whole extension length of the at least one mast;

the at least one mainsail is a sail that is deformable so as to adapt to a path of the sliding guide and for a lowering and in operating positions thereof has an extension in a vertical direction;

the mainsail has a main edge proximal to the mast and slidably fixed for the whole length thereof along a sliding path, the mainsail in the operating position is entirely placed aft with respect to the mast with reference to the advancement direction; and the mast comprises a second sliding guide positioned substantially at the top thereof and placed aft with respect to the at least one overturning section to define a support from below, in the vertical direction, and slidable, to the mainsail during the passage in the overturning section.

2. The sailing boat according to claim 1, wherein the second sliding guide is not constrained to the mainsail.

3. The sailing boat according to claim 1, wherein the mainsail is substantially four-sided with a side of a major base arranged to form a proximal edge, wherein in the operating position, the mainsail has a symmetry with respect to a substantially horizontal plane of symmetry.

4. The sailing boat according to claim 1, wherein the mainsail has a wing-shaped section thickness preferably with asymmetrical camber along a chord.

5. The sailing boat according to claim 1, wherein the second sliding guide supports the mainsail at least in a distanced point in a horizontal direction towards aft with respect to the at least one overturning section.

6. The sailing boat according to claim 1, wherein the mainsail comprises a plurality of stiffening elements arranged in succession with each other along the sliding path, alternating with deformation zones that allow adaptation to the sliding path.

7. The sailing boat according to claim 6, wherein the stiffening elements are stiffening sticks coupled to the mainsail in direct contact with the second sliding guide.

8. The sailing boat according to claim 7, wherein a ratio between a distance of successive stiffening elements and the extension of the second sliding guide is such that, during a passage of mainsail over the at least one overturning section, at least one of each pair of adjacent stiffening elements is supported by the second guide.

9. The sailing boat according to claim 1, wherein the second sliding guide supports the mainsail so as to keep the mainsail arranged substantially parallel to the advancement direction.

10. The sailing boat according to claim 1, wherein the mainsail has a free distal edge movable towards and away from a vertical plane of symmetry of the mast when the mainsail is in the operating position, where the second sliding guide limits mobility of a second edge section downwards when the mainsail passes from the at least one overturning section of the first guide.

11. The sailing boat according to claim 1, wherein in the operating position, the mainsail does not have any section, or at the most it only has a top portion, located at the second sliding guide.

12. The sailing boat according to claim 1, wherein the at least one overturning section extends along a first concave line downwards substantially continually joined to the top of the sections of mast, and the second sliding guide extends along a second concave line downwards that substantially starts at the top of the first and the second section of mast and is distanced from the at least one overturning section remaining substantially facing in a horizontal direction.

13. The sailing boat according to claim 1, wherein the second sliding guide comprises at least one rod projecting aft from the at least one overturning section between the first and the second section of mast.

14. The sailing boat according to claim 1, wherein the first sliding guide comprises a rail and the proximal edge of the mainsail is fixed slidably to the mast through a plurality of carriages slidably coupled to the rail, where the carriages each comprise a sliding point with respect to the rail and a coupling point to the proximal edge, and where each carriage comprises at least one articulated point to allow the mainsail to change inclination with respect to the mast.

15. A mainsail for a sailing boat comprising at least one mast and a mainsail wherein:

the at least one mast comprises at least one first and one second section projecting upwards with respect to a hull and arranged facing each other in an orthogonal direction to a hull advancement direction, wherein the first and second sections support the mainsail in two mutually specular and alternative operating positions, wherein the sections are connected and spaced out from each other by at least one overturning section located at a top of each section to allow a passage of the mainsail from one specular position to another specular position defining the two mutually specular positions, wherein the sections of the mast define a first sliding guide for the mainsail that extends substantially along the whole extension length of the at least one mast;

the at least one mainsail is a sail that is deformable so as to adapt to a path of the sliding guide and for a lowering and in operating positions thereof has an extension in a vertical direction;

the mainsail has a main edge proximal to the mast and slidably fixed for the whole length thereof along a sliding path, the mainsail in the operating position is entirely placed aft with respect to the mast with reference to the advancement direction; and the mast comprises a second sliding guide positioned substantially at the top thereof and placed aft with respect to the at least one overturning section to define a support from below, in the vertical direction, and slidable, to the mainsail during the passage in the overturning section.

16. A mast for a sailing boat comprising at least one mast and a mainsail, wherein:

the at least one mast comprises at least one first and one second section projecting upwards with respect to a hull and arranged facing each other in an orthogonal direction to a hull advancement direction, wherein the first and second sections support the mainsail in two mutually specular and alternative operating positions, wherein the sections are connected and spaced out from each other by at least one overturning section located at a top of each section to allow a passage of the mainsail from one specular position to another specular position defining the two mutually specular positions, wherein the sections of the mast define a first sliding guide for the mainsail that extends substantially along the whole extension length of the at least one mast;

the at least one mainsail is a sail that is deformable so as to adapt to a path of the sliding guide and for a lowering and in operating positions thereof has an extension in a vertical direction;

the mainsail has a main edge proximal to the mast and slidably fixed for the whole length thereof along a sliding path, the mainsail in the operating position is entirely placed aft with respect to the mast with reference to the advancement direction; and the mast comprises a second sliding guide positioned substantially at the top thereof and placed aft with respect to the at least one overturning section to define a support from below, in the vertical direction, and slidable, to the mainsail during the passage in the overturning section.

* * * * *